United States Patent [19]

Mason

[11] 4,372,098

[45] Feb. 8, 1983

[54] METHOD OF MAKING AN APPLICATOR PACKAGE

[75] Inventor: Edwin W. Mason, Wyckoff, N.J.

[73] Assignee: Mason Keller Corporation, Roseland, N.J.

[21] Appl. No.: 260,190

[22] Filed: May 5, 1981

Related U.S. Application Data

[60] Continuation-in-part of Ser. No. 85,813, Oct. 17, 1979, abandoned, which is a division of Ser. No. 639,961, Dec. 11, 1975, abandoned.

[51] Int. Cl.[3] ..... B65B 5/02

[52] U.S. Cl. ..... 53/412; 53/449; 53/453; 53/467; 53/474; 53/478; 401/132

[58] Field of Search ..... 53/412, 452, 453, 463, 53/464, 471, 474, 431, 559, 435; 128/268; 206/229, 438; 401/132

[56] References Cited

U.S. PATENT DOCUMENTS

| | | | |
|---|---|---|---|
| 2,629,378 | 2/1953 | Barton | 128/268 |
| 2,999,265 | 9/1961 | Duane et al. | 128/268 |
| 3,299,464 | 1/1967 | O'Brien et al. | 128/268 X |
| 3,301,392 | 1/1967 | Regan, Jr. | 206/438 X |
| 3,333,393 | 8/1967 | Sparks | 53/412 |
| 3,397,508 | 8/1968 | Stroop | 53/559 |
| 3,429,096 | 2/1969 | Griese, Jr. | 53/471 |
| 3,486,504 | 12/1969 | Austin, Jr. | 401/132 X |
| 3,490,448 | 1/1970 | Grubb | 128/268 X |
| 3,577,700 | 5/1971 | Bippus et al. | 53/559 X |
| 3,613,879 | 10/1971 | Kemble | 206/438 X |
| 3,673,760 | 7/1972 | Canamero et al. | 53/559 X |
| 3,851,441 | 12/1974 | Marchand | 53/559 X |
| 3,860,348 | 1/1975 | Doyle | 401/132 X |
| 3,913,562 | 10/1975 | Moore et al. | 206/438 X |
| 3,921,802 | 11/1975 | Thompson | 206/229 X |

*Primary Examiner*—Horace M. Culver

*Attorney, Agent, or Firm*—Lackenbach, Siegel, Marzullo, Presta & Aronson

[57] ABSTRACT

The method of forming applicator packages comprises the steps of feeding a continuous web of material, such as one comprising an aluminum foil having an inner coating of a thermoplastic material; forming successively a plurality of recesses along the web of material; depositing a fabric applicator pad into each said recess; securing said fabric applicator to the inside portion of said recess by means such as heat sealing said pad to the thermoplastic lining of said aluminum foil; dispensing a predetermined quantity of product to be applied by said fabric applicator, to said applicator; feeding another continuous web of material from a supply roll so as to be continuously aligned in a coextensive manner with said first web of material, said other web of material comprising, for example, an aluminum foil having an inner coating of a thermoplastic material; sealing the peripheral marginal edges of each applicator package so as to form a thermoplastic hermetic closure about all sides of said recess leaving at least one corner portion of said webs of material unsecured together; and cutting off each said applicator package from said webs of material.

10 Claims, 9 Drawing Figures

METHOD OF MAKING AN APPLICATOR PACKAGE

RELATED APPLICATIONS

This application is a continuation-in-part of my copending U.S. patent Application Ser. No. 85,813, filed Oct. 17, 1979, and now abandoned, which is in turn a divisional patent application of my earlier filed U.S. patent application Ser. No. 639,961, filed Dec. 11, 1975, now abandoned.

BACKGROUND OF THE INVENTION

This invention relates to a method of making an applicator package and, in particular, to a method of making a package for enclosing an applicator containing a material to be applied, such as a liquid antiseptic or the like, in a manner such that the material may be applied after the opening of the package without handling of the applicator or the material.

Heretofore, in the application of materials such as liquid antiseptics or the like, it has been necessary to apply the material to an applicator, such as an absorbent pad or the like, and then to apply the pad to the area to be treated. This method of application has resulted in the wasting of the material to be applied in cases where it is applied to the applicator in quantities that are too large, and in contamination of the material to be applied or the applicator by the handling of same prior to its application to the area to be treated. Additionally, in the case of materials that stain or are difficult to remove, this method of application has resulted in the staining of the fingers, hands and/or clothing of the person applying same.

Even in the case of packaged applicators that are presupplied with the material to be applied, it has been necessary to handle the applicator before applying it to the area to be treated, thereby resulting in some of the disadvantages described above, namely, the contamination of the applicator or the staining of the fingers, hands or clothing of the person applying the material with the applicator.

Accordingly, it will be readily seen that a need has arisen for a simple package for a material applicator which can be easily opened and which enables the material to be applied to the area to be treated without handling of the applicator or the material. The package of the present invention fulfills this need and is not subject to any of the disadvantages hereinbefore described.

SUMMARY OF THE INVENTION

The applicator package of the present invention comprises opposed side panels, and an applicator means secured to one of the side panels and being disposed between them, the applicator means carrying the material to be applied. The side panels are removably and sealingly secured together at their edge portions in surrounding relation to the applicator means, thereby enclosing and sealing the applicator means between the side panels. One area of the edge portions of the side panels is unsecured to enable the side panels to be gripped at this area and separated from each other to expose the applicator means for application of the material.

Since the applicator means is secured to one of the side panels, it may be applied to the area to be treated without handling same, by merely gripping the edge portion of the side panel to which it is secured. In this manner, contamination of the applicator and staining of the person applying same are avoided.

In the case where the material to be applied is a liquid, the side panels are formed of a suitable liquid impervious material and the applicator is formed of an absorbent material which is impregnated with the liquid. Preferably, the side panel to which the applicator means is secured is provided with a recessed central portion in which the applicator means is positioned.

As a specific example, the side panel having the recessed portion may be formed of metallic foil with a coating of thermoplastic material on the interior surface thereof. In this case, the applicator means is heat-sealed to the interior surface of the recessed portion, and the edge portion of the side panel surrounding the recessed portion is heat-sealed to the opposing edge portion of the other side panel.

In accordance with the method of manufacturing the applicator package of the present invention, the applicator means is secured to the interior surface of one of the said panels and is then provided with the material to be applied. Thereafter, the side panels are secured together at their edge portions in surrounding relation to the applicator means to enclose and hermetically seal the applicator means between the side panels.

One area extending beyond the seal edge portions of the side panels is left unsecured to enable the side panels to be gripped at this area and separated from each other to expose the applicator means for the application of the material to be applied.

DESCRIPTION OF THE PREFERRED EMBODIMENTS

Figure 2:
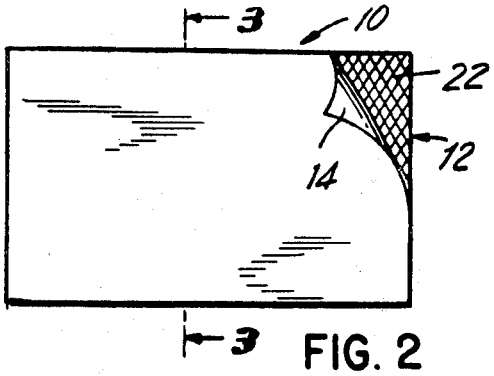
FIG. 2 is a view similar to FIG. 1, showing the package in a partially open condition at the unsecured corner.

As shown in FIGS. 1 through 5, the applicator package 10 of the present invention comprises a pair of opposed side panels 12 and 14 formed of any suitable material depending on the contents of the package 10. Preferably, the first side panel 12 comprises a recessed central portion 16 and a substantially flat edge portion 18 surrounding the recessed portion 16. The second side panel 14 is of substantially flat configuration.

An applicator means 20, such as an absorbent pad or the like, is disposed within the central portion 16 of the side panel 12 and is secured in any suitable manner to the inner surface of the side panel 12 within the central recessed portion 16. The applicator means 20 may be formed of any suitable material. If the material to be applied is a liquid, the applicator means 20 preferably is formed of an absorbent material, such as cotton, sponge rubber or the like, and is impregnated with the liquid material.

Figure 1:
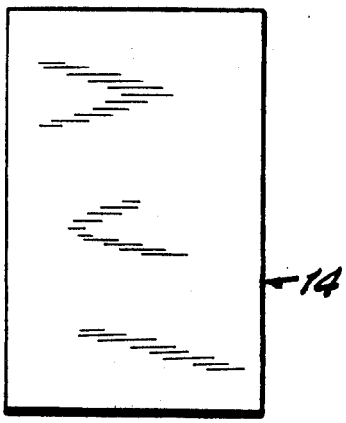
FIG. 1 is a plan view of a closed applicator package formed in accordance with the principles of the present invention.
Figure 3:
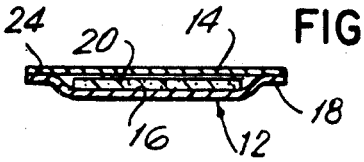
FIG. 3 is a sectional view taken substantially along the line 3—3 in FIG. 1.
Figure 5:
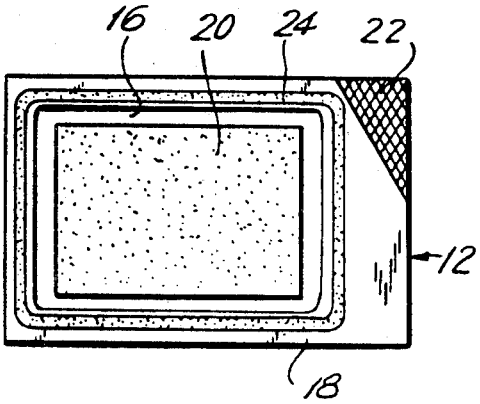
FIG. 5 is another plan view of the same side panel of the package shown in FIG. 4, but separated from the side panel with the recess.

In order to seal the applicator means 20 within the package 10, the edge portions of the side panels 12 and 14 are secured together in surrounding relation to the applicator means 20, thereby enclosing and hermetically sealing the applicator means between the side panels in the manner shown in FIGS. 1 and 3.

As specifically shown in FIGS. 1 and 2, one are of the edge portions of the side panels 12 and 14 is unsecured to enable the side panels to be gripped at this area and separated from each other to expose the applicator means 20 for application of the material contained thereon or therein. This area of the edge portion of the first side panel 12 preferably is knurled at 22 to provide for easy gripping thereof.

Figure 4:
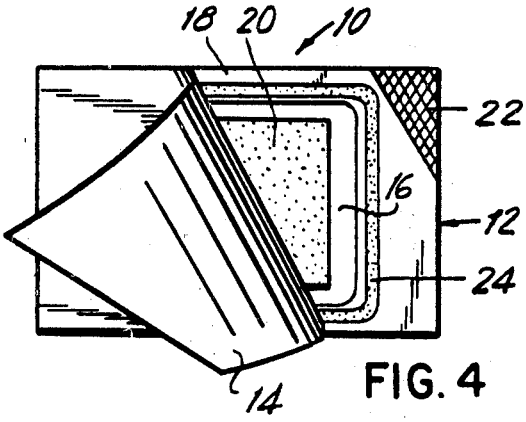
FIG. 4 is a further plan view of the package of the present invention, showing the applicator means secured in the recess and with the removable side panel substantially separated from the other side panel provided with the recess.
Figure 6:
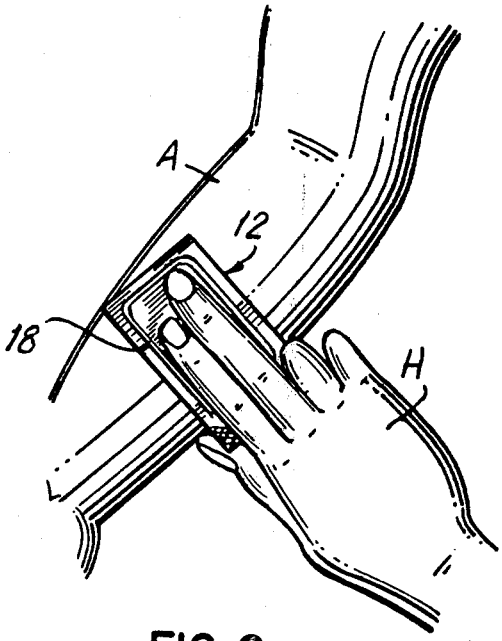
FIG. 6 is a perspective view showing the use of the package of this invention after it has been opened to apply the material to an area to be treated.

Once the side panel 14 has been fully separated from the side panel 12 to expose the applicator means 20, as shown in FIG. 4, the side panel 12 may be gripped at its edge portion with a person's hand H to apply the applicator means 20 to an area to be treated, such as an arm A (as shown in FIG. 6) without any need to grip or touch the applicator means 20. In this manner, contamination of the applicator means 20 and the material to be applied, as well as staining of the fingers, hand or clothing of the person applying the applicator means is avoided.

As a specific example, in the case of a liquid material to be applied, the side panels 12 and 14 are formed of a suitable liquid impervious material such as metallic foil, and the applicator means 20 preferably is an absorbent pad that is impregnated with the liquid material to be applied. Preferably, the first side panel 12 is provided with a thermoplastic coating on the inner surface thereof adjacent the applicator means 20 so that the applicator means may be conveniently heat-sealed or secured thereto. Similarly, the edge portions of the side panel 12 and/or side panel 14 may also be provided with a thermoplastic coating on the interior surface thereof so as to enable the edge portions of the side panels to be conveniently heat-sealed together to enclose and seal the applicator means therein. If desired, a line of thermoplastic or other adhesive 24 may be provided on the edge portion of the side panel 12 surrounding the central recessed portion 16 thereof for the purpose of providing an adequate connection and seal between the side panels 12 and 14.

The package 10 of the present invention is especially useful for enclosing an applicator means 20 containing an antiseptic liquid, such as iodine, which can stain a person's hands and clothing and is difficult to remove. With the use of the present package, the applicator means can be conveniently exposed and applied to the area to be treated by merely holding the edge portion of the side panel 12 without any direct contact with the applicator means or the material contained thereon or therein.

In accordance with the method of forming the applicator package of the present invention, the applicator means 20 is first secured to the inner surface of the side panel 12 within the recessed central portion 16 in any suitable manner, such as by heat-sealing. Thereafter, the applicator means 20 is impregnated or otherwise supplied with the material to be applied. Finally, the edge portion of the second side panel 14 is secured to the edge portion of the side panel 12 in any suitable manner, such as by heat-sealing, to enclose and hermetically seal the applicator means 20 between the side panels. For the purpose of facilitating the separation of the side panels to expose the applicator means 20, one area of the edge portions of the side panels is unsecured to enable them to be conveniently gripped and aseptically pulled apart.

Figure 7:
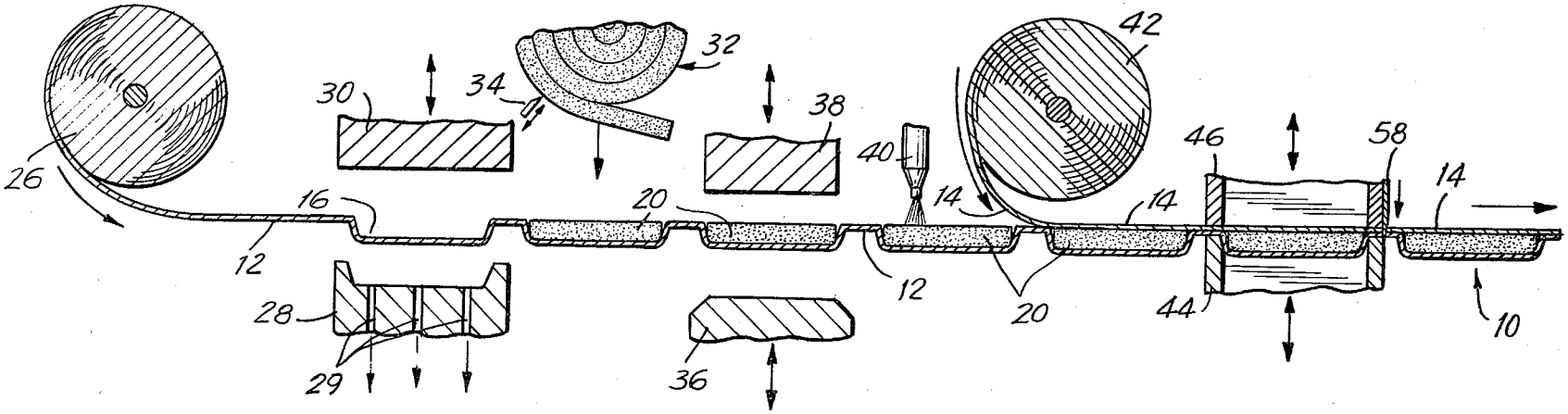
FIG. 7 is a schematic view, generally in section, of an assembly line for forming applicator packages by the method of the invention.

More particularly, the method of the invention is illustrated in FIG. 7 of the drawing. As best shown therein, the method of making an applicator package 10 comprises the steps of feeding the bottom web material or first side panel 12, preferably from a continuous supply roll 26, and forming a recess 16 therein, preferably when using a continuous supply roll 26 so as to successively form therein a plurality of recesses 16 as the continuous web of material 12 is intermittently advanced along the line of operational steps employed in the method or process of manufacturing the applicator packages 10. It should also be recognized that the web of material 12 can be of any width so that multiple recesses 16 are formed transversely across the web of material 12. The recess or recesses 16 are formed, preferably by clamping the web of material 12 between a bottom female die 28, having one or more recesses, and a top plate member 30. Drawing is accomplished with pneumatic pressure against such clamped web over the female die 28.

Other suitable arrangements may be used to form the recesses, such as employing a male die with or without a vacuum, but such steps may involve the use of other materials for the web. Passageways 29 are connected to pneumatic means for drawing the clamped web in the female die 28 for forming the recess or recesses 16.

The applicator means 20 which is used as the pad stock or reservoir and swab applicator for the product material to be applied is suitably fed in an intermittent manner from a supply stock, such as the continuous pad stock roll 32. Each pad or applicator means 20 is preferably released from the supply roll 32, for example, by cutting with a knife edge 34 and dropped into the recess or recesses 16. Alternatively, the pad stock 20 may be fed intermittently from another form of supply means, such as a hopper feeder stacked with a plurality of precut applicator means or pads 20.

Subsequently to the step of depositing the applicator pad 20, the pad or pads 20 are secured preferably by heat sealing to the bottom of the recess or recesses 16, by means of a vertically movable heated flat outline die 36 and a back-up element 38. Thereafter, a predetermined dosage of the product material to be applied is deposited onto the pad or pads 20 by suitable means, such as a dispenser 40.

Figure 8:
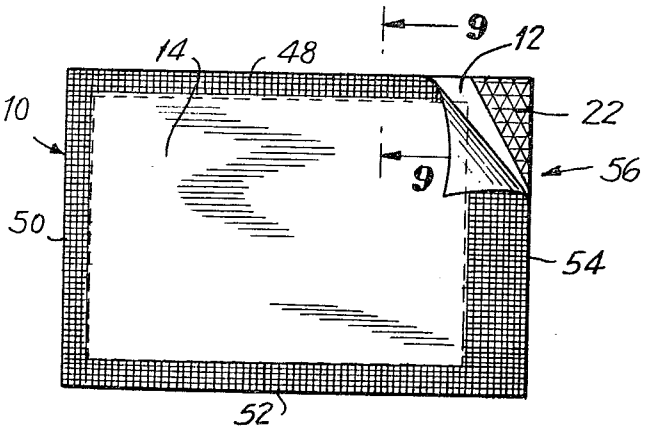
FIG. 8 is a plan view of an applicator package, similar to that shown in FIG. 2.

In the next step or operation of the method of the invention, a top web material or second side panel 14 is fed, also preferably from a continuous supply roll 42, and it is suitably coextensively aligned with the bottom web material; and the top and bottom webs of material are then assembled together by pressing them between vertically activated mating heating dies 44 and 46 which basically define the seal areas 48, 50, 52 and 54 and the aseptic corner separation area 56 with the knurled triangular portion 22 of the first side panel 12, as is best shown in FIG. 8. Suitable severing means, such as a knife 58 cuts off a completely assembled applicator package 10 or packages if a plurality of rows are formed across the web.

Figure 9:
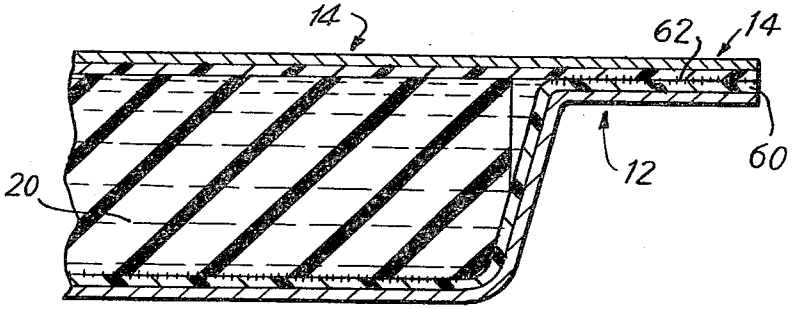
FIG. 9 is a sectional view taken substantially along the lines 3—3 of FIG. 2.

FIG. 9 illustrates in greater detail the laminated construction of the web materials 12 and 14. Preferably, the bottom web 12 is of a formable material, such as aluminum foil having a thermoplastic coating or lining 60, such as polyethylene, vinyl or the like. The top web 14 is also made of a suitable material, such as aluminum foil or coated paper laminated to or provided with a thermoplastic coating or lining 62, such as polyethylene, vinyl or the like. The coatings or linings 60, 62 are in the nature of a heat activatable coating which hermetically seal the webs together completely about and around the recess 16 so as to protect the applicator means 20 and product liquid dispensed into the recess and applicator pad means.

Suitable materials for the applicator means or pad may comprise cellulose pads, fabric pads, non-woven textile pads, plastic fibrous mats, foamed plastic synthetic fiber, such as cotton and the like. Rayon, polypropylene and combinations thereof are also applicable products. The absorbent pad 20 may be suitably saturated with the product liquid to be applied and packaged. Thus, topical medications such as iodine, may be suitably packaged and stored for a considerable period of time, except that the foil outer material should preclude the transmission of any moisture.

Some of the characteristics and properties of the materials for the applicator package are that the bottom web material must be formable or capable of drawing into a recess under pressure and/or vacuum. The applicator means must be absorbent and capable of holding a reservoir of fluid and it must also exhibit good release qualities. In addition, the top web of material must also be compatible with the product to be applied and at the same time thermoplastically sealable with the bottom web.

Other examples of suitable web multi-laminates which can form a leak-proof vapor tight sealed applicator package may comprise, for example, a paper-polyethylene-aluminum foil-vinyl coating or vinyl-aluminum foil laminated combination. The plastic coating or layer on the aluminum foil providing the best overall long term shelf-life or storage capability as it effectively precludes any product material from wicking through the walls of the web material and attacking the foil even for strong, or "corrosive" like liquids, such as a povidone-iodine product solution of say 90% water-10% iodine. It is well known that iodine chemically changes aluminum foil to aluminum iodine, which is a white powder instead of an aluminum sheet material so it is critical in most applicators to protect the foil. As an example of a barrier, a polyester or other like material may be employed so long as proper bonds between the various materials or layers can be achieved.

Generally, the thickness of each of the laminate layers may be anywhere in the order of approximately 0.0005 up to as high as 0.010 inch for the majority of materials employed in most applications.

The following is a specific example of a highly effective applicator package:

| | |
|---|---|
| Top Web | Printed paper<br>Polyethylenelaminate<br>Aluminum foil - .00035<br>Polyester - .0005<br>Polyethylene - .0015<br>SATURATED PAD |
| Bottom Web | Polyethylene - .0015<br>Polyester - .0005<br>Formable foil - .002 |

In addition to the above example, an overcoating may be applied to the printed paper of the top web so as to prevent any printed matter provided on the paper from being removed accidentally by wiping, etc.

Other alternate examples of effective applicator packages are:

| | |
|---|---|
| Top Web | Mylar - .0005 inch<br>Aluminum foil - .001<br>Vinyl coating<br>1.5–2" Absorbent (Saturated)<br>Pad - 2.3cc.–3.5cc. product |
| Bottom Web | Vinyl - .0012<br>Aluminum foil - .0015 |
| Top Web | Paper<br>Polyethylene<br>Aluminum Foil<br>Vinyl Coating<br>PAD |
| Bottom Web | Vinyl<br>Aluminum Foil |
| Top Web | Scuff-resistant overcoat<br>Multi-color printing<br>Paper<br>Polyethylene<br>Foil<br>Vinyl Coating<br>PAD |
| Bottom Web | Vinyl<br>Foil |

All of the above different type of applicator packages made by the method of the present invention all exhibit excellent properties, such as seal strength, packaging material delamination, no loss of weight even under extreme temperatures of about 130° F. and the applicator pad does not exhibit any loosening characteristics.

As noted hereinbefore, the product material generally preferred for use in the applicator package of the invention may comprise various medicants such as an antiseptic, cleansing or bacteriastatic agent or material.

Bear in mind that various combinations of laminations may be employed in the practice of the method of the invention, depending upon the specific properties of the overall package which are to be achieved, but the basic web configuration for the top and bottom materials of a thermoplastic-foil is characteristic of all applicator packages made by the process of the present invention.

It is also to be understood that the foregoing only relates to the preferred embodiments of the method of the invention and that numerous substitutions, modifications and alterations are permissible without departing from the scope of the invention as defined by the following claims.

What is claimed is:

1. A method of forming applicator packages, said method comprising the steps of:

feeding a first continuous web of material having multilaminated layers comprising at least a foil layer and a heat activatable layer from a supply roll, said material comprising an aluminum foil having an inner coating of a thermoplastic material, such as polyethylene;

forming successively a plurality of recesses along said first web of material;

depositing a fabric applicator pad into each of said recesses;

securing said fabric applicator to the inside portion of each said recess by means of heat sealing said pad to the thermoplastic polyethylene lining of said aluminum foil;

dispensing a predetermined quantity of product to each said applicator pad;

feeding a second continuous web of material having multilaminated layers comprising at least a foil layer and a heat activatable layer from a supply roll so as to be continuously aligned in a coextensive manner with said first web of material, said second web of material comprising an aluminum foil having an inner coating of a thermoplastic material, such as polyethylene;

simultaneously heat sealing the entire peripheral marginal edges of each applicator package so as to form a thermoplastic hermetic closure about all sides of said recess leaving at least one corner portion of said webs of material unsecured together;

cutting off each said applicator package from said webs of material; and the thickness of any laminate layer is is from about 0.00035 to about 0.010 inch with said foil ranging from about 0.00035 to about 0.003 inch in thickness and said thermoplastic material ranging in thickness from about 0.0005 to about 0.002 inch.

2. The method according to claim 1, wherein at least one recess is formed in rows oriented transversely of said first web of material.

3. The method according to claim 2, wherein an applicator pad is deposited in each recess of said rows of recesses disposed transversely of said first web of material.

4. The method according to claim 3, wherein said applicator pad is secured to each recess of said rows of recesses, and thereafter said product is dispensed into said applicator pad secured to each recess of said rows of recesses.

5. The method according to claim 4, wherein the peripheral marginal edges of each applicator package corresponding to said at least one recess formed in rows oriented transversely of said first web of material are sealed, and thereafter said at least one applicator package in said at least one recess in rows oriented transversely of said first web of material is cut off.

6. The method according to claim 5, wherein said transverse rows of recesses each comprise a plurality of recesses.

7. The method according to claim 1, wherein said method involves an in-line operation with the webs of material guided so as to be coextensively aligned during their assembly and sealing along said peripheral marginal edges.

8. The method according to claim 1, wherein said first web of material comprises a formable foil layer and said for polyethylene layer, with said foil layer not being the exterior layer of said bottom web of material.

9. The method according to claim 1, wherein said first web of material comprises a formable foil layer, a polyethylene layer and said polyethylene coating, with said foil layer being the exterior outer layer of said bottom web of material.

10. The method according to claim 1, wherein said second web of material comprises said foil layer, a polyethylene layer and said polyethylene coating.

* * * * *